US006259237B1

(12) United States Patent
Fischer

(10) Patent No.: US 6,259,237 B1
(45) Date of Patent: Jul. 10, 2001

(54) METHOD AND APPARATUS FOR PROVIDING HIGH CURRENT POWER REGULATION

(75) Inventor: Eugene Fischer, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/227,832

(22) Filed: Jan. 11, 1999

Related U.S. Application Data

(63) Continuation-in-part of application No. 09/185,579, filed on Nov. 4, 1998.

(51) Int. Cl.[7] ..... G05F 1/573; G05F 1/44; G05F 1/56

(52) U.S. Cl. ..... 323/277; 323/285; 323/282

(58) Field of Search ..... 323/277, 276, 323/282, 283, 284, 285

(56) References Cited

U.S. PATENT DOCUMENTS

| | | | | |
|---|---|---|---|---|
| 3,199,015 | * | 8/1965 | Lackey et al. | 363/45 |
| 3,337,787 | * | 8/1967 | Joseph | 363/24 |
| 3,473,039 | * | 10/1969 | Fegley | 307/11 |
| 3,818,308 | * | 6/1974 | Tamari | 363/56 |
| 4,024,451 | * | 5/1977 | Nishino et al. | 363/24 |
| 5,663,876 | * | 9/1997 | Newton et al. | 363/126 |

* cited by examiner

*Primary Examiner*—Peter S. Wong
*Assistant Examiner*—Bao Q. Vu
(74) *Attorney, Agent, or Firm*—Burns, Doane, Swecker & Mathis, LLP

(57) ABSTRACT

The present invention is directed to an apparatus and method for providing a regulated DC output voltage suitable for high power (e.g., high current), high transmission rate systems in a relatively straightforward, cost efficient manner. Exemplary embodiments of the present invention can provide stable DC voltage outputs possessing essentially no AC component over the desired operating voltage range (e.g., at a 5 volt DC output, virtually no AC component over one millivolt range peak-to-peak is present), and possesses a high current capability (e.g., at a 5 volt DC output exemplary embodiments can accommodate currents in excess of 0.5 amps (A) up to 7 A or greater). The ability to provide a very stable, high current capability voltage regulator is especially desirable for communication systems, and in particular, wireless communication systems, wherein transmission rates are on the order of 125 Mb/s or higher, and transmission power is on the order of 0.5 to 2 watts (W) or higher. Because of its high current capability, voltage regulators in accordance with exemplary embodiments of the present invention are suitable for use in conjunction with high power (e.g., 0.5 W) monolithic millimeter wave integrated circuits (MMICs). Exemplary embodiments possess a high signal-to-noise (SB) ratio, and a bit error rate on the order of $10^{-12}$ or lower with 99.99% availability.

16 Claims, 3 Drawing Sheets

METHOD AND APPARATUS FOR PROVIDING HIGH CURRENT POWER REGULATION

RELATED APPLICATIONS

The present application is a continuation-in-part of U.S. application Ser. No. 09/185,579, filed Nov. 4, 1998 and entitled: METHOD AND APPARATUS FOR HIGH FREQUENCY WIRELESS COMMUNICATION, the disclosure of which is hereby incorporated by reference in its entirety. In addition, the present application relates to U.S. application Ser. No. 09/227,833, filed on even date herewith, and entitled "METHOD AND APPARATUS FOR VARYING THE POWER LEVEL OF A TRANSMITTED SIGNAL", the disclosure of which is hereby incorporated by reference, its entirety.

BACKGROUND OF THE INVENTION

1. Field of the Invention

The present invention relates generally to communication systems and methods, and more particularly, to a voltage regulator which can provide reliable voltage regulation for high current applications.

2. State of the Art

Communication systems which employ wireless transceivers are well known. However, as is the case with most electronic technologies today, there is an ever increasing demand to improve information transmission rates and range (that is, power output), while at the same time, reducing the influence of noise and improving the quality of transmission. In addition, there is always increasing demand to broaden the applicability of wireless communications to technologies still dependent on wired or fiber linked communication, such as mainframe-to-mainframe communications where high data rate and high power requirements have precluded the use of conventional wireless communications. To satisfy these competing concerns, a compromise is often reached whereby some sacrifice in transmission rate is accepted to enhance the integrity of the data transmitted. In addition, some sacrifice in transmission range is accepted to reduce the transceiver's circuit complexity and cost.

One feature of conventional communication systems which affects transmission power is the voltage regulator used to supply operating voltages to transmitter and receiver portion of the system. Although a wide variety of voltage regulators are known for information transmission/reception, the availability of voltage regulators which can satisfy the current requirements of a high power, long range transmission system is somewhat limited. To the extent that suitable voltage regulators exist, they tend to be unstable, and exhibit an undesirable noise performance characteristic. Efforts to improve the stability of such voltage regulators results in relatively complex circuit configurations which are impractical from size and cost efficiency standpoints.

Accordingly, it would be desirable to provide an apparatus and method for providing a regulated DC output voltage using a cost effective, straightforward approach that can satisfy the power requirements of high power (e.g., 0.5 to 2 watts (W), or higher), high transmission rate systems (e.g., having operating frequencies on the order of 18–40 gigahertz (GHz) spectrums or wider, and actual transmission rates on the order of 100 to 125 megabits per second (125 Mb/s) or higher).

SUMMARY OF THE INVENTION

The present invention is directed to an apparatus and method for providing a regulated DC output voltage suitable for high power (e.g., high current), high transmission rate systems in a relatively straightforward, cost efficient manner. Exemplary embodiments of the present invention can provide stable DC voltage outputs possessing essentially no AC component over the desired operating voltage range (e.g., at a 5 volt DC output, virtually no AC ripple component over approximately one millivolt peak-to-peak is present), and possesses a high current capability (e.g., at a 5 volt DC output exemplary embodiments can accommodate currents in excess of 0.5 amps (A) up to 7 A or greater). The ability to provide a very stable, high current capability voltage regulator is especially desirable for communication systems, and in particular, wireless communication systems, wherein transmission rates are on the order of 125 Mb/s or higher, and transmission power is on the order of 0.5 to 2 watts (W) or higher. Because of its high current capability, voltage regulators in accordance with exemplary embodiments of the present invention are suitable for use in conjunction with high power (e.g., 0.5 W) monolithic millimeter wave integrated circuits (MMICs). Exemplary embodiments possess a high signal-to-noise (SB) ratio, and a bit error rate on the order of $10^{-12}$ or lower with 99.99% availability.

Generally speaking, exemplary embodiments of the present invention are directed to an apparatus and method for providing a regulated DC output voltage, comprising: means for receiving an input voltage; and means for regulating said input voltage to provide at least one DC voltage output having a stable DC voltage of approximately 5.0 volts and a current capability of at least 0.5 amps which possesses no AC peak-to-peak ripple components of greater than approximately 1 millivolt. Exemplary embodiments are applicable for use in supplying sufficient operating power for high power components, such as monolithic millimeter wave integrated circuits.

Alternate embodiments of the present invention are generally directed to an apparatus and method for providing a regulated DC output voltage comprising: means for receiving a first input voltage of a first polarity; means for determining presence of a second input voltage of a second polarity; and means for regulating said first input voltage to produce a regulated DC output voltage in response to said detecting means.

BRIEF DESCRIPTION OF THE DRAWINGS

Other objects and advantages of the present invention will become apparent to those skilled in the art upon reading the following detailed description of preferred embodiments, in conjunction with the accompanying drawings, wherein like reference numerals have been used to designate like elements, and wherein.

DETAILED DESCRIPTION OF THE PREFERRED EMBODIMENTS

Power supplies of components, such as transmitters are often provided via an on-board transmitter voltage regulator or regulators. In an exemplary embodiment, three such voltage regulators can be included: a first regulator for a data input means and data processing means of the transmitter, a second regulator for the portion of the power output means used to establish amplification channels, and a third regulator for recombining the signals from the power amplification channels into a single RF output. Of course, those skilled in the art will appreciate that a single regulator, or any number of regulators can be used to provide the power supplies to the various components of the circuits.

Figure 1:
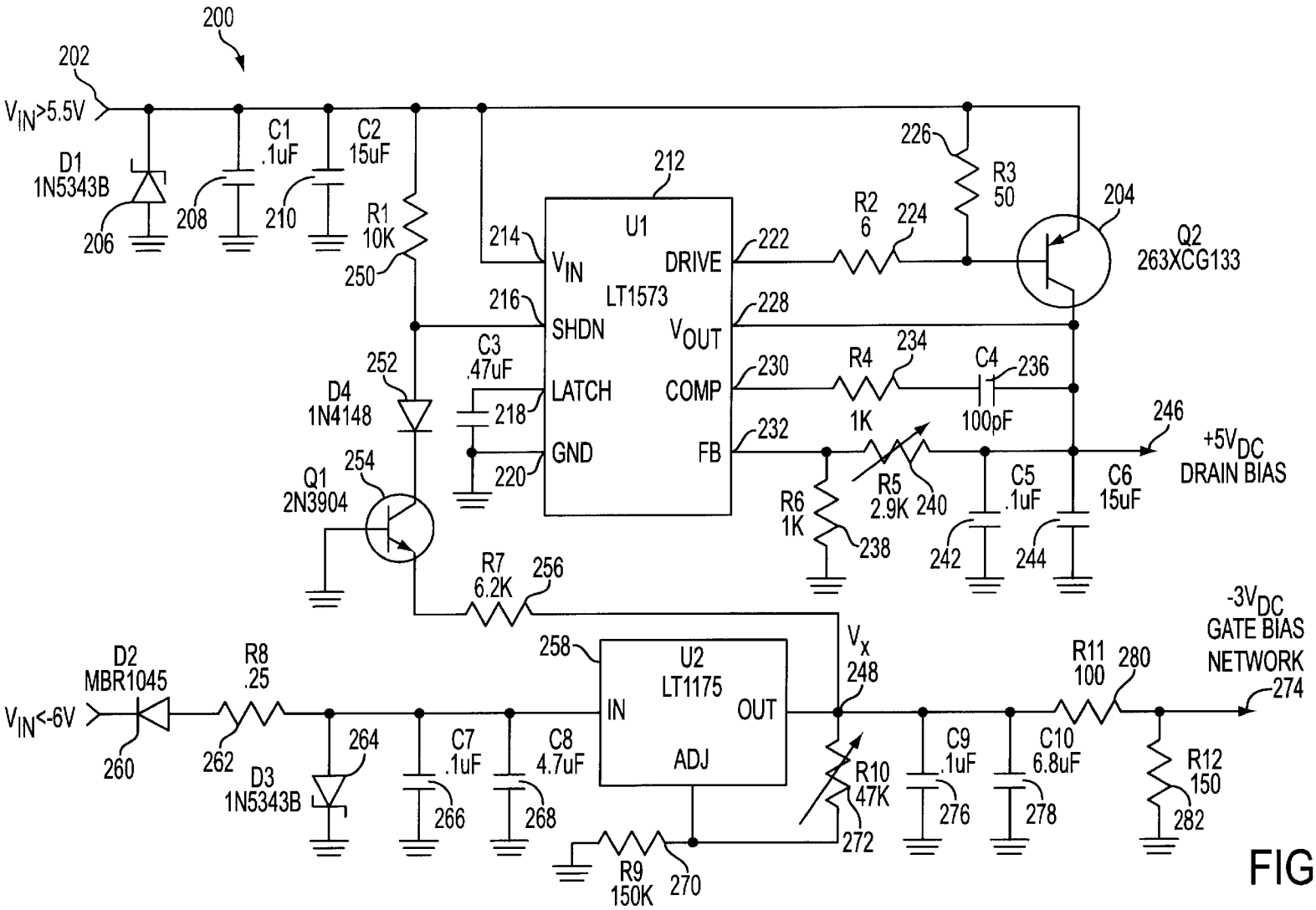
FIG. 1 shows an exemplary block diagram of a voltage regulator which can be used, for example, in conjunction with a communication system transmitter.

An exemplary voltage regulator in accordance with an exemplary embodiment of the present invention, is illustrated in FIG. 1. FIG. 1 shows an exemplary embodiment of a transmitter voltage regulator 200. In the exemplary embodiment shown, the regulator is a DC voltage regulator having a 0.3 voltage drop at 7 to 8 amps, with 1–3 W power dissipation. A low voltage drop can be achieved from the input to the output of the regulator through the use of components illustrated, such as the use of a pnp transistor as an output switch. Because the exemplary embodiment illustrated is a monolithic device, it is somewhat sensitive to the effects of high current. Accordingly, exemplary embodiments are configured with a means for protecting the circuit against high currents. For example, in the exemplary embodiments illustrated, if a proper negative voltage is not obtained as a gate bias control voltage, a positive voltage cannot appear at the drain bias output of the circuit.

Referring to FIG. 1, the transmitter regulator 200 includes a node which receives an input voltage $V_{in}$ on the order of 5.5 volts, or any other desired input voltage. The voltage input, designated 202 is used as the supply for the drain of a voltage switch 204, represented as a pnp transistor Q2, such as a transistor designated 263XCG133, available from Solitron Corporation.

The voltage input 202 is supplied via voltage stabilizing and filter components represented in the exemplary FIG. 1 embodiment as a Zener diode 206, and parallel capacitors 208 and 210. The voltage input 202 is also supplied as the input voltage to a voltage regulator chip 212, such as the chip designated LT1573 available from Linear Technology, Inc. The voltage regulator chip 212 also includes a shutdown input 216, a latch input 218, and a ground connection 220.

Outputs of the voltage regulator chip 212 include a drive output 222 for driving the base of the voltage switch 204 via a voltage divider comprised of resistors 224 and 226. An additional output of the voltage regulator chip is designated as the voltage output, $V_{out}$, which is connected to the collector of the voltage switch 204. The voltage regulator chip 212 includes a comparison output 230. The comparison output 230 is supplied to the collector of the voltage switch 204 via a resistor 232, a resistor 234 and a capacitor 236. The compare output compares a feedback signal from the regulator output with the $V_{out}$ voltage to monitor collector current and to adjust a setpoint. The feedback is received via a feedback input 232 connected to the collector of the voltage switch 204, via resistor 238, adjustable resistor 240, and capacitors 242 and 244. The adjustable resistor permits adjustment of the drain bias voltage output from the regulator. The output from the collector of the voltage switch 204 is, in the exemplary embodiment illustrated, a five volt DC bias 246.

To protect the circuit against high current fluctuations, the transmitter regulator is configured with a protective means, which includes a switch to enable the voltage regulator chip 212. In the FIG. 1 embodiment, the voltage regulator chip 212 cannot operate unless a voltage $V_x$ at a node 248 is determined to be sufficiently negative. The shutdown input 216 of the voltage regulator chip 212 is connected to a node between resistor 250 and a switch which includes a series arrangement of a diode 252 and a transistor 254. The diode 252 is connected to the collector of transistor 254 which can, for example, be a transistor chip 2N3904 available from Solitron Corp. The base of this transistor is grounded, and the drain is connected via a resistor 256 to the node 248.

The node 248 corresponds to the output of a negative voltage regulator, such as the regulator LT1175 available from Linear Technology, Inc. The negative voltage regulator 258 receives an input voltage on the order of −6 volts, or less, supplied via a reverse biased diode 260, a resistor 262, and a voltage stabilizing filter circuit which includes a Zener diode 264, capacitor 266 and capacitor 268 connected in parallel.

The desired value of $V_x$ at node 248 can be adjusted via a divider network that includes a resistor 270 and an adjustable resistor 272. The voltage $V_x$ is supplied to a second output of the transmitter regulator to provide a gate bias on the order of −3 volts DC, at the output 274. The voltage $V_x$ is supplied to the regulator output 274 via a filter which includes capacitor 276, a capacitor 278, and via a voltage divider network which includes resistors 280 and 282. Exemplary component values for each of the components shown in FIG. 1 are illustrated.

In operation, when the proper voltage is output from the negative voltage regulator 258 to the node 248, the transistor 248 responds (e.g., is gated on) to establish a current path from the input 202 to the node 248 via the series arrangement of diode 252 and transistor 254, such that the shutdown input 216 of the voltage regulator chip 212 remains inactive. However, if the voltage at node 248 rises above a predetermined threshold established by the user such that it becomes at or near zero, or positive, current will not flow from the voltage input 202 to the node 248. Rather, current can flow from the voltage input 202 into the shutdown input 216 of the voltage regulator 212, thereby causing the voltage regulator chip 212 to inhibit a drain bias voltage at the output 246 of the transmitter regulator 200.

The gate voltage at the output 274 is controlled to be within a desired voltage range, such as between −1 volt and −3 volts, depending on the adjustments made to adjustable resistor 272, to control current throughout the transmitter. When a predetermined negative voltage appears at the node 248 (and thus, the output 274), then the voltage regulator 212 will be enabled to provide the 5 volt drain bias as a stable DC voltage at the output 246. As referenced herein, a "stable" DC voltage is one which, for the DC voltage range of interest, has no, or at most negligible, AC components (e.g., a 5 V DC output is stable if no AC ripple component on the order of 1 approximately millivolt or greater, peak-to-peak, is present in the DC output). Similar transmitter regulators can be included for the other components of the FIG. 1 transmitter as discussed previously.

The FIG. 1 block diagram can be used, for example, with a transmitter configured to transmit information, such as data, at actual information rates on the order of 100 to 125 Mb/s, or lower or higher. Those skilled in the art will appreciate that this actual transmission rate must account for overhead, such as conventional error correction, clock synchronization signals, and so forth. As such, the rate with which the data is transmitted will be somewhat lower (for example, 100 Mb/s). Although FIG. 1 illustrates a regulator for use with a transmitter, those skilled in the art will appreciate that the regulator can be configured as part of a transceiver which includes both a transmitter (such as that of FIG. 1) and a receiver, or with a receiver alone.

The exemplary FIG. 1 embodiment is configured for use in supplying sufficient operating power for high power components, such as monolithic millimeter wave integrated circuits. For example, exemplary embodiments can be used with a transmitter that can produce a power output on the order of 0.5 to 2 W using four parallel 0.5 W channels. High power (e.g., 0.5 W) monolithic millimeter wave integrated circuits (MMICs), previously used in radar technology, can be used in the transmitter and receiver portions of a transceiver according to exemplary embodiments of the present invention to achieve full duplex, high power wireless communications with a simple circuit design. The high power outputs and fast information transmit/receive rates enable the use of wireless communications for broadband networking technologies and interconnectivity medium standards such as the synchronous digital hierarchy (SDH) known as the synchronous optical network SONET/SDH (e.g., SONET ring architectures having self-healing ring capability). Using available MMICs, such as high quality, low noise MMIC amplifiers, a five decibel (dB) noise figure or lower can be realized in a receiver portion. A transmitter configured using one or more MMICs can be used in conjunction with a receiver of the transceiver to provide point-to-point full duplex operation at operating frequencies in a fixed wireless spectrum range of 18–40 GHz (e.g., on the order of, for example, 20 GHz to 40 GHz) or wider, in contiguous 50 megahertz (MHz) segments (or any other specified operating frequency range), over a range of the order of 2 kilometers (km) with, for example, 40 dB range attentuation or higher. Such transmitters are suitable for a variety of applications including, but not limited to, point-to-point wireless communications between computers, such as between personal computers, between computer networks and between mainframe computers over broadband networks with high reliability.

Although a plurality of separate integrated circuits are available to implement the various functions of the FIG. 1 embodiment, those skilled in the art will appreciate that all of the functions can be configured onto a single substrate to further enhance compactness.

Figure 2:
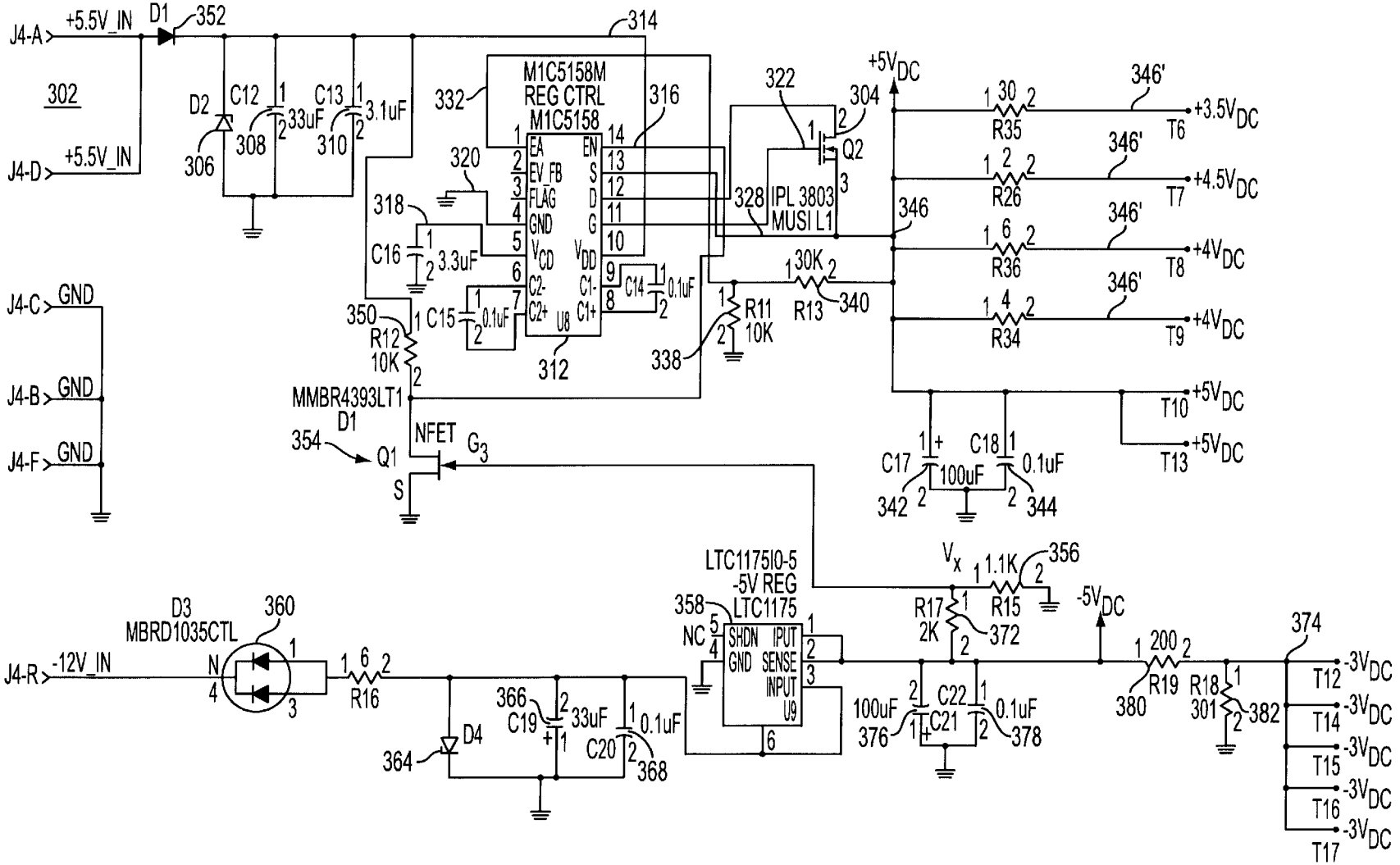
FIG. 2 shows an alternate exemplary embodiment of the FIG. 1 voltage regulator.

FIG. 2 shows a regulator 300, representing an alternate exemplary embodiment of the FIG. 1 voltage regulator. In FIG. 2, portions of the diagram which have functions that correspond to those of components in FIG. 1 are similarly labeled. In the FIG. 2 regulator 300, the regulator chip 212 of the FIG. 1 embodiment has been replaced with a regulator chip 312 such as the MIC5158M voltage regulator chip available from Micrel Technology Inc. In addition, the pnp output switch 204 of the exemplary FIG. 1 embodiment has been replaced with a power metal oxide semiconductor field effect transistor (MOSFET) 304 (labeled "Q2").

As with the FIG. 1 embodiment, operation of the exemplary FIG. 2 embodiment functions to produce a negative voltage $V_x$ which turns on a switch; that is, the series arrangement of the transistor 354 (labeled Q1) via the diode 352. When an appropriate negative voltage appears at the node $V_x$, the regulator chip 312 is enabled to produce a regulated positive output voltage through the power MOSFET 304. As shown in the FIG. 2 embodiment, multiple outputs 346' can be provided, having different voltages, using voltage dividers.

Thus, the exemplary embodiments of FIGS. 1 and 2 both function to provide an output voltage regulating sequence, whereby a voltage of a first polarity is generated and detected, such that the voltage regulator can be enabled to produce an output voltage of a second polarity. Like the exemplary embodiment described with respect to FIG. 1, the FIG. 2 embodiment produces very stable output voltages. For example, in an output voltage of approximately 5 volts (e.g., 5 volts±2 volts) AC components on the order of one millivolt peak-to-peak are undetectable. Thus, the output is a very clean and stable.

Figure 3:
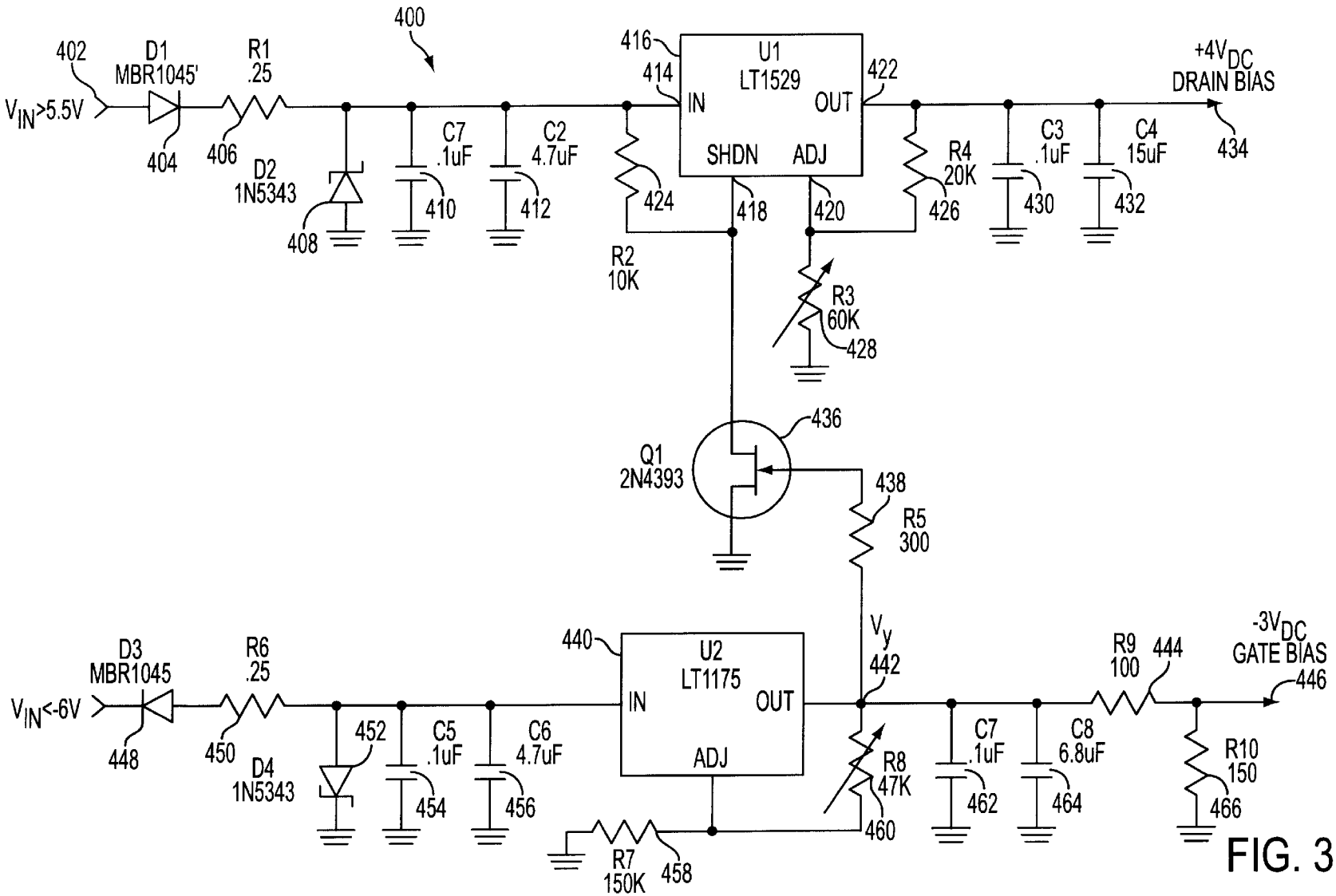
FIG. 3 shows an exemplary embodiment of a voltage regulator for use in conjunction with, for example, a communication system receiver.

In accordance with yet another exemplary embodiment of the present invention, an exemplary DC voltage regulator for a receiver portion is illustrated in FIG. 3. Referring to FIG. 3, a receiver voltage regulator 400 includes a voltage input 402, on the order of 5.5 volts or greater. This input is supplied via a voltage stabilizing and filter network which includes diode 404, resistor 406, Zener diode 408, capacitor 410 and capacitor 412, to an input 414 of a positive voltage regulator 416. The positive voltage regulator 416 includes a shutdown input 418, an adjustment input 420 and an output 422. A feedback resistor 424 is connected between the input 414 and the shutdown 418. The adjustment input 420 is controlled by a voltage divider that includes a resistor 426 and an adjustable resistor 428. The output of the positive voltage regulator is supplied to a DC drain bias output on the order of 4 volts via filter capacitors 430 and 432.

The shutdown input 418 is controlled by a switch, such as a MOSFET transistor 436 designated 2N4393 available from Solitron Corp., whose drain is grounded and whose collector is connected to the shutdown input. A gate of the transistor 436 is connected via a resistor 438 to the output of a negative voltage regulator 440 configured similar to that of the negative voltage regulator in FIG. 1. The output of the negative voltage regulator 440, designated $V_y$ at node 442, is supplied via a resistor 444 to a gate bias output 446, on the order of −3 volts. The negative voltage regulator 440 is driven at its input by an input voltage on the order of −6 volts or less, supplied via a voltage stabilizing and filter network which includes a reverse biased diode 448, a resistor 450, and a parallel combination of a Zener diode 452, a capacitor 454 and a capacitor 456. The negative voltage regulator 440 can be adjusted via a voltage divider that includes a resistor 458 and an adjustable resistor 460. The output of the negative voltage regulator is supplied to the gate bias output 446 via a filter network which includes capacitors 462, 464, and a voltage divider network that includes resistor 444 and resistor 466.

As with the FIG. 1 transmitter regulator, the FIG. 3 receiver regulator only provides the drain bias output when an appropriate voltage $V_y$ is present at the node 442, and an appropriate gate bias is present at output 446. Operation of the FIG. 3 regulator with respect to a shutdown of the positive voltage regulator 416, is similar to the operation described with respect to the FIG. 1 regulator.

Although exemplary embodiments of the present invention have been described in the context of communication systems which use transmitters and receivers, those skilled in the art will appreciate that the invention is not so limited. Rather, exemplary embodiments of the present invention can be used whenever a regulated DC voltage is required. The applicability of the exemplary embodiments will, of course, be suitable to those applications where high current demands exist. Exemplary embodiments can be used in conjunction with any computer or computer applications, and can be used whenever high current capabilities are required with regard to any regulated DC voltage.

Changes can also be implemented with respect to each of the various circuit diagrams described above. For example, any types of transistors or switches which can be used to perform the functions described above can be incorporated to replace the components as shown. For example, in the FIG. 3 embodiment, the resistor $R_4$ can be changed to adjust voltage from the 4–5 volt output to any other desired voltage (e.g., a 15 or 16 volt output). The same applies with respect to the exemplary FIG. 1 and FIG. 2 embodiments. In addition, although various current capabilities have been described, those skilled in the art will appreciate that the invention is not limited to any specific current range. For example, in the exemplary FIG. 1 embodiment, the 5 volt output can, for the exact circuit component shown, supply current on the order of 2 amps. However, the exemplary FIG. 2 embodiment can provide 5 volts with an output current capability of up to 20 amps or greater. Thus, those skilled in the art will appreciate that by selecting appropriate components for a given application, the voltage and current capabilities of the regulator can be adjusted accordingly.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Apparatus for providing a regulated DC output voltage, comprising:

means for receiving an input voltage; and means for regulating said input voltage to provide at least one DC voltage output having a stable DC voltage in a range of from approximately 3.0 volts to approximately 7.0 volts and a current capability of at least 0.5 amps, wherein said stable DC voltage possesses no AC peak-to-peak ripple components of greater than approximately 1 millivolt peak-to-peak throughout the range.

2. Apparatus according to claim 1, wherein said current capability is at least approximately 7 amps.

3. Apparatus according to claim 1, wherein said regulating means includes:

a first voltage regulator for producing a voltage output of a first polarity; and a second voltage regulator for producing a voltage output of a second, opposite polarity.

4. Apparatus according to claim 3, wherein said regulating means produces said at least one DC output voltage from one of said first and second voltage regulators in response to an output from the other of said first and second voltage regulators.

5. Apparatus according to claim 4, wherein said regulating means includes:

an output switch which is controlled in response to said one of said first and second voltage regulators.

6. Apparatus according to claim 5, wherein said output switch includes a pnp transistor.

7. Apparatus according to claim 5, wherein said output switch includes a MOSFET.

8. Apparatus according to claim 1, wherein said regulating means produces a positive DC output voltage and a negative DC output voltage.

9. Apparatus according to claim 1, wherein said regulating means includes:

a positive voltage regulator for producing a positive DC output voltage;

a negative voltage regulator form producing a negative DC voltage output; and a switch for enabling said positive DC voltage regulator in response to receipt of a threshold voltage from said negative voltage regulator.

10. Apparatus according to claim 9, wherein said switch includes:

a transistor and a diode connected in series.

11. Apparatus according to claim 9, wherein said threshold voltage is adjustable.

12. Method for providing a regulated DC output voltage, comprising the steps of:

receiving an input voltage; and regulating said input voltage to provide at least one DC voltage output having a stable DC voltage in a range of from approximately 3.0 volts to approximately 7.0 volts and a current capability of at least 0.5 amps, wherein said stable DC voltage possesses no AC peak-to-peak ripple components of greater than approximately 1 millivolt peak-to-peak throughout the range.

13. Apparatus for providing a regulated DC output voltage comprising:

means for receiving a first input voltage of a first polarity;

means for determining presence of a second input voltage of a second polarity; and means for regulating said first input voltage to produce a regulated DC output voltage in response to said determining means.

14. Apparatus according to claim 13 wherein said determining means includes:

a voltage regulator for producing a negative voltage output; and;

said regulating means includes:

a voltage regulator for producing a positive voltage output.

15. Apparatus according to claim 14, wherein said regulating means produces said at least one DC output voltage using a voltage regulator which responds to an output from another voltage regulator included within said determining means.

16. Apparatus according to claim 15, wherein said regulating means includes:

an output switch which is controlled in response to said voltage regulator of said determining means.

* * * * *

UNITED STATES PATENT AND TRADEMARK OFFICE

CERTIFICATE OF CORRECTION

PATENT NO. : 6,259,237 B1
DATED : July 10, 2001
INVENTOR(S) : Eugene Fischer

It is certified that error appears in the above-identified patent and that said Letters Patent is hereby corrected as shown below:

Column 8, claim 9,
Line 8, please delete the word "form", and insert the word -- for --.

Signed and Sealed this

Twenty-sixth Day of February, 2002

*Attest:*

*Attesting Officer*

JAMES E. ROGAN
*Director of the United States Patent and Trademark Office*